US010515584B2

(12) United States Patent
Cho et al.

(10) Patent No.: US 10,515,584 B2
(45) Date of Patent: Dec. 24, 2019

(54) ORGANIC LIGHT EMITTING DISPLAY DEVICE CAPABLE OF IMPROVING DISPLAY QUALITY, AND METHOD OF DRIVING THE SAME

(71) Applicant: SAMSUNG DISPLAY CO., LTD., Yongin-si, Gyeonggi-do (KR)

(72) Inventors: Sung Yeon Cho, Yongin-si (KR); Hui Nam, Yongin-si (KR); Tae Jin Kim, Yongin-si (KR); Myung Ho Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 134 days.

(21) Appl. No.: 15/018,544

(22) Filed: Feb. 8, 2016

(65) Prior Publication Data

US 2017/0061875 A1 Mar. 2, 2017

(30) Foreign Application Priority Data

Aug. 27, 2015 (KR) ..... 10-2015-0121000

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC ..... G09G 3/3233; G09G 2300/0819; G09G 2320/0238; G09G 2300/0842
See application file for complete search history.

(56) References Cited

U.S. PATENT DOCUMENTS

2006/0038754 A1 2/2006 Kim
2011/0025659 A1* 2/2011 Kwak ..... G09G 3/3233 345/205
(Continued)

FOREIGN PATENT DOCUMENTS

KR 10-0592641 B1 6/2006
KR 10-0703430 B1 4/2007
(Continued)

OTHER PUBLICATIONS

Abstract of Korean Patent Publication No. 1020070015825 A, Feb. 6, 2007 Corresponding to Korean Patent No. 10-0703430 A1, Apr. 3, 2007, 1 Page.

*Primary Examiner* — Jonathan M Blancha
(74) *Attorney, Agent, or Firm* — Lewis Roca Rothgerber Christie LLP

(57) ABSTRACT

An organic light emitting display device including a scan driver configured to supply scan signals to scan lines, and configured to supply emission control signals to emission control lines, a data driver configured to supply data signals to data lines, pixels respectively including driving transistors configured to be initialized by a voltage of an initializing power source, an initializing power source generator configured to supply the voltage of the initializing power source to an initializing power source line commonly connected to the pixels, and a timing controller configured to control the scan driver, the data driver, and the initializing power source generator, wherein the initializing power source generator is configured to supply the initializing power source having different voltages during a first period in which the scan signals are supplied, and during a second period of a low frequency driving period in which the scan signals are not supplied.

13 Claims, 8 Drawing Sheets

(52) U.S. Cl.
CPC ..... *G09G 2300/0861* (2013.01); *G09G 2310/0251* (2013.01); *G09G 2320/0238* (2013.01)

(56) References Cited

U.S. PATENT DOCUMENTS

| | | | | |
|---|---|---|---|---|
| 2011/0025677 | A1* | 2/2011 | Park | G09G 3/3258 345/212 |
| 2012/0001893 | A1* | 1/2012 | Jeong | G09G 3/3233 345/213 |
| 2013/0321376 | A1* | 12/2013 | Kim | G09G 3/3233 345/212 |
| 2013/0335397 | A1* | 12/2013 | Kim | G09G 3/006 345/212 |
| 2014/0085284 | A1* | 3/2014 | Sun | G09G 3/3233 345/211 |
| 2014/0168290 | A1 | 6/2014 | Yang et al. | |
| 2014/0184968 | A1 | 7/2014 | Niikura et al. | |
| 2014/0306946 | A1 | 10/2014 | Senda | |

FOREIGN PATENT DOCUMENTS

| | | | |
|---|---|---|---|
| KR | 10-2014-0078920 | A | 6/2014 |
| KR | 10-2014-0086847 | A | 7/2014 |
| KR | 10-2014-0123219 | A | 10/2014 |

* cited by examiner

ORGANIC LIGHT EMITTING DISPLAY DEVICE CAPABLE OF IMPROVING DISPLAY QUALITY, AND METHOD OF DRIVING THE SAME

CROSS-REFERENCE TO RELATED APPLICATION

This application claims priority to, and the benefit of, Korean Patent Application No. 10-2015-0121000, filed on Aug. 27, 2015, in the Korean Intellectual Property Office, the entire contents of which are incorporated herein by reference.

BACKGROUND

1. Field

Embodiment of the present invention relate to an organic light emitting display device and a method of driving the same.

2. Description of the Related Art

With the development of information technology, importance of display apparatuses as connection mediums between users and information is emerging. Accordingly, uses of display apparatuses, such as liquid crystal display devices and organic light emitting display devices, are increasing.

Among the display apparatuses, an organic light emitting display device displays an image by using organic light emitting diodes (OLED) that generate light components by re-combination of electrons and holes. The organic light emitting display device has a high response speed, and is driven with low power consumption.

The organic light emitting display device includes a plurality of pixels arranged at crossing regions of a plurality of data lines, scan lines, and power source lines that are arranged in a matrix. Each of the pixels is commonly formed of an OLED, two or more transistors including a driving transistor, and one or more capacitors.

The organic light emitting display device uses a relatively small amount of power. However, due to variations in threshold voltages of driving transistors included in the pixels, amounts of currents that flow to the OLEDs may differ, thereby causing non-uniformity in display. Therefore, a method of diode-connecting the driving transistors and of compensating the threshold voltages of the driving transistors is suggested.

However, when the driving transistors are diode-connected, a leakage current is generated by a current path connected to gate electrodes of the driving transistors and an initializing power source, and by a current path connected to the gate electrodes of the driving transistors and the OLEDs.

The leakage current may be insignificant when the organic light emitting display device is driven by a normal driving frequency. However, when the organic light emitting display device is driven by a low frequency to reduce power consumption, brightness components of the pixels may change due to the leakage current. Therefore, a method of stably maintaining the brightness components of the pixels when the organic light emitting display device is driven by the low frequency is required.

SUMMARY

Embodiments of the present invention relate to an organic light emitting display device capable of improving display quality, and a method of driving the same.

An organic light emitting display device according to an embodiment of the present invention includes a scan driver configured to supply scan signals to scan lines, and configured to supply emission control signals to emission control lines, a data driver configured to supply data signals to data lines, pixels respectively positioned at regions defined by the scan lines and the data lines, and respectively including driving transistors configured to be initialized by a voltage of an initializing power source, an initializing power source generator configured to supply the voltage of the initializing power source to an initializing power source line commonly connected to the pixels, and a timing controller configured to control the scan driver, the data driver, and the initializing power source generator, wherein the initializing power source generator is configured to supply the initializing power source having different voltages during a first period in which the scan signals are supplied to the scan lines, and during a second period of a low frequency driving period in which the scan signals are not supplied to the scan lines.

The initializing power source generator may be configured to supply a voltage of a first initializing power source in the first period, and may be configured to supply a voltage of a second initializing power source in the second period.

The first initializing power source may have a lower voltage than the data signal.

The second initializing power source may have a higher voltage than the first initializing power source.

The initializing power source generator may include a first switching transistor connected between the first initializing power source and the initializing power source line, and configured to be turned on during the first period, and a second switching transistor connected between the second initializing power source and the initializing power source line, and configured to be turned on in the second period.

The organic light emitting display device may further include a storage unit configured to store data items to be supplied during the first period.

The initializing power source generator may be configured to supply a voltage of a first initializing power source in the first period, and may be configured to supply a voltage of one of a second initializing power source to a jth initializing power source in the second period, j being a natural number larger than 2.

The initializing power source generator may be configured to supply the voltage of one of the second initializing power source to the jth initializing power source in response to the data items stored in the storage unit.

The first initializing power source may have a lower voltage than the data signal.

The second initializing power source to the jth initializing power source may each have a higher voltage than the first initializing power source.

The initializing power source generator may include a first switching transistor connected between the first initializing power source and the initializing power source line, which may be configured to be turned on in the first period, and second to jth switching transistors connected between the initializing power source line and a respective one of the second initializing power source to the jth initializing power source.

The timing controller may be configured to turn on the first switching transistor during the first period, and may be configured to turn on one of the second transistor to the jth switching transistor in response to the data items stored in the storage unit during the second period.

At least one of the pixels may include an organic light emitting diode (OLED), a corresponding one of the driving transistors as a first transistor that is configured to control an amount of a current supplied from a first power source, which is connected to a first electrode of the first transistor, to the OLED, which is connected to a second electrode of the first transistor, in response to a voltage of a first node, and a second transistor connected between the initializing power source line and the first node, and configured to be turned on when a scan signal of the scan signals is supplied to a previous scan line of the scan lines.

The at least one of the pixels may further include a third transistor connected between the second electrode of the first transistor and the first node, and configured to be turned on when a scan signal of the scan signals is supplied to a present scan line of the scan lines, a fourth transistor connected between a data line and the first electrode of the first transistor, and configured to be turned on when the scan signal is supplied to the present scan line, a fifth transistor connected between the first power source and the first electrode of the first transistor, and configured to be turned off when an emission control signal of the emission controls signals is supplied to a present emission control line of the emission control lines, a sixth transistor connected between the second electrode of the first transistor and an anode electrode of the OLED, and configured to be turned off when the emission control signal is supplied to the present emission control line, and a storage capacitor connected between the first power source and the first node.

The at least one of the pixels may further include a seventh transistor connected between the initializing power source line and the anode electrode of the OLED, and may be configured to be turned on in at least a partial period of a period during which the emission control signal is supplied to the present emission control line.

According to another embodiment of the present invention, there is provided a method of driving an organic light emitting display device, the method including supplying a voltage of a first initializing power source as an initializing power source during a first period of a low frequency driving period in which scan signals are supplied to scan lines, and supplying a voltage of a second initializing power source as the initializing power source during a second period of the low frequency driving period in which the scan signals are not supplied to the scan lines.

The first initializing power source may have a lower voltage than data signals supplied to the data lines.

The second initializing power source may have a higher voltage than the first initializing power source.

The method may further include storing data items to be supplied during the first period, and controlling a voltage level of the second initializing power source in response to the stored data items.

In the organic light emitting display device and the method of driving the same according to the embodiment of the present invention, during low frequency driving, in the first period in which scan signals are supplied to the scan lines, the voltage of the first initializing power source that is lower than the voltages of the data signals is supplied to the pixels and, in the second period in which scan signals are not supplied to the scan lines, the voltage of the second initializing power source that is higher than the voltage of the first initializing power source is supplied to the pixels. Then, in the second period, the leakage current of the pixels is reduced or minimized so that display quality may be improved.

In addition, according to embodiments of the present invention, the voltage of the second initializing power source is controlled by using the data items stored in the first period so that the gate electrodes of the driving transistors included in the pixels maintain stable voltages. Therefore, display quality may be improved.

BRIEF DESCRIPTION OF THE DRAWINGS

Example embodiments will now be described more fully hereinafter with reference to the accompanying drawings, in which.

DETAILED DESCRIPTION

Figure 1:
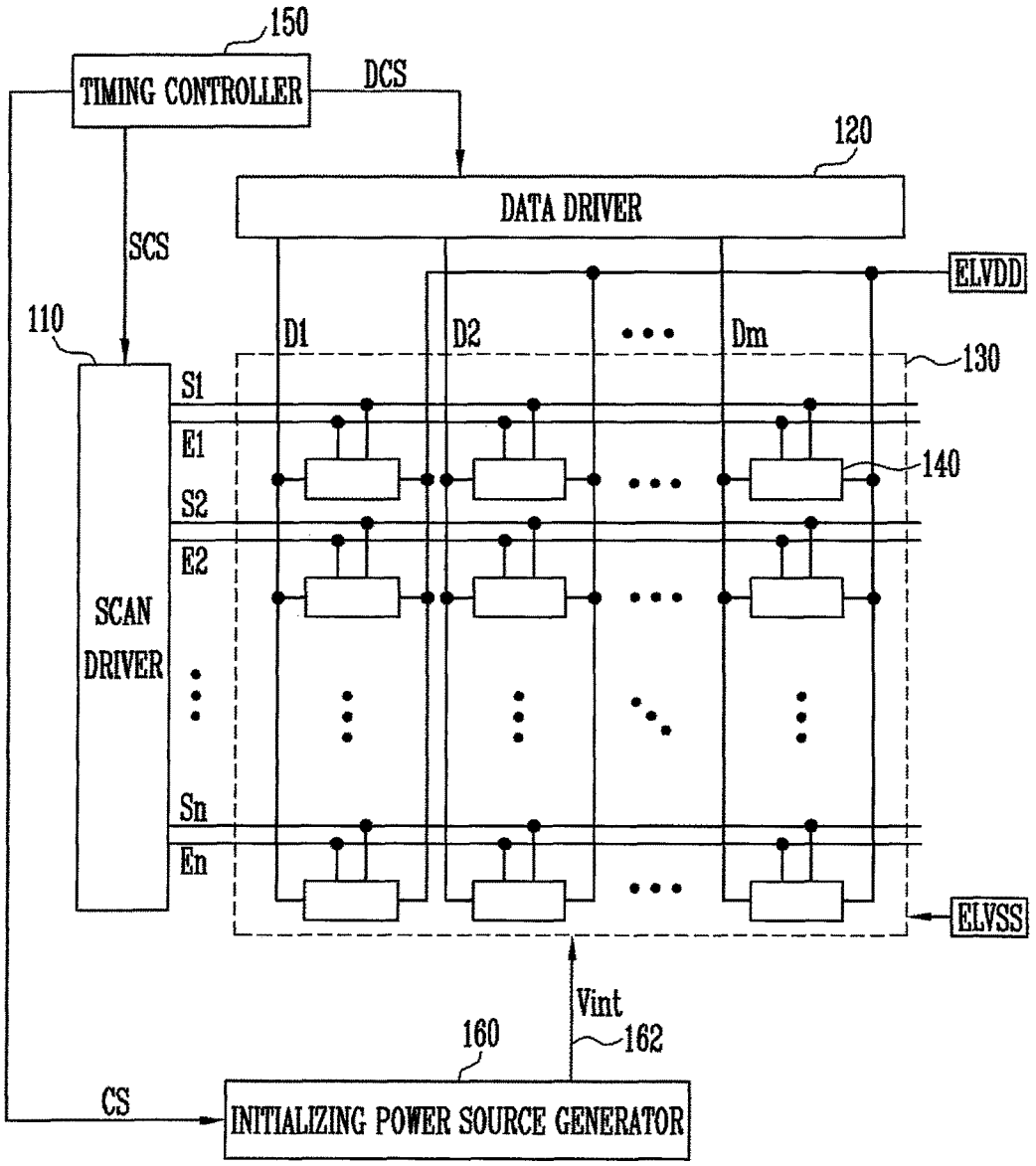
FIG. 1 is a block diagram illustrating an organic light emitting display device according to an embodiment of the present invention.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating an organic light emitting display device according to an embodiment of the present invention.

Referring to FIG. 1, the organic light emitting display device according to the present embodiment includes a pixel unit 130 including pixels 140 respectively positioned in crossing regions of scan lines S1 to Sn and data lines D1 to Dm, a scan driver 110 for driving the scan lines S1 to Sn and emission control lines E1 to En, a data driver 120 for driving the data lines D1 to Dm, an initializing power source generator 160 for supplying a voltage of an initializing power source Vint to the pixels 140, and a timing controller 150 for controlling the scan driver 110, the data driver 120, and the initializing power source generator 160.

The scan lines S1 to Sn and the emission control lines E1 to En extend in a first direction, and the data lines D1 to Dm extend in a second direction. Here, the first direction may be a horizontal direction, and the second direction may be a vertical direction.

The timing controller 150 is configured to control the scan driver 110, the data driver 120, and the initializing power source generator 160 in response to signals supplied from the outside. For this purpose, the timing controller 150 supplies a scan control signal SCS to the scan driver 110, supplies a data control signal DCS to the data driver 120, and supplies a control signal CS to the initializing power source generator 160.

The scan driver 110 is configured to supply scan signals to the scan lines S1 to Sn in response to the scan control signal SCS, and is configured to supply emission control signals to the emission control lines E1 to En. For example, the scan driver 110 sequentially supplies the scan signals to the scan lines S1 to Sn, and may sequentially supply the emission control signals to the emission control lines E1 to En.

Here, an emission control signal may have a larger width than (e.g., may be longer than) a scan signal. For example, an emission control signal supplied to an ith emission control line Ei (i being a natural number) may temporally overlap at least scan signals supplied to an (i−1)th scan line Si-1 and an ith scan line Si. In addition, the emission control signals may have gate off voltages (for example, high voltages) so that transistors included in the pixels 140 may be turned off, and the scan signals may have gate on voltages (for example, low voltages) so that the transistors included in the pixels 140 may be turned on.

The data driver 120 is configured to supply data signals to the data lines D1 to Dm in response to the data control signal DCS. The data signals supplied to the data lines D1 to Dm are supplied to the pixels 140 selected by the scan signals.

The initializing power source generator 160 is configured to supply the voltage of the initializing power source Vint to an initializing power source line 162 that is commonly connected to the pixels 140 in response to the control signal CS. Here, the initializing power source generator 160 is configured to supply a voltage of a first initializing power source as the initializing power source Vint, the voltage being a lower voltage than the data signals, when the organic light emitting display device is driven by a normal frequency. In addition, the initializing power source generator 160 is configured to supply the voltage of the first initializing power source as the initializing power source Vint in a first period in which the scan signals are supplied to the scan lines S1 to Sn during a low frequency driving period. The initializing power source generator 160 is configured to supply a voltage of a second initializing power source as the initializing power source Vint, the voltage being a higher voltage than the first initializing power source, in a second period in which the scan signals are not supplied to the scan lines S1 to Sn during the low frequency driving period, which will be described in detail later.

The pixel unit 130 includes the pixels 140 respectively positioned in regions defined by the scan lines S1 to Sn, the emission control lines E1 to En, and the data lines D1 to Dm. The pixels 140 store the data signals from the data lines D1 to Dm when the scan signals are supplied. The pixels 140 that store the data signals generate light components with brightness components corresponding to the respective data signal while controlling amounts of currents that flow from a first power source ELVDD to a second power source ELVSS via organic light emitting diodes (OLED) in response to the data signals.

In addition, in FIG. 1, the n scan lines S1 to Sn and the n emission control lines E1 to En are illustrated. However, the present invention is not limited thereto. For example, at least one dummy scan line and at least one dummy emission control line may be present in a structure of the pixel 140. Each of the pixels 140 may be additionally connected to a scan line and/or an emission control line positioned in another horizontal line, as opposed to a present horizontal line in which the pixel 140 is formed, according to a circuit structure.

In addition, in FIG. 1, the scan driver 110 is illustrated as being connected to the scan lines S1 to Sn and the emission control lines E1 to En. However, the present invention is not limited thereto. For example, the emission control lines E1 to En may be connected to a separate driver, and may receive the emission control signals.

Figure 2:
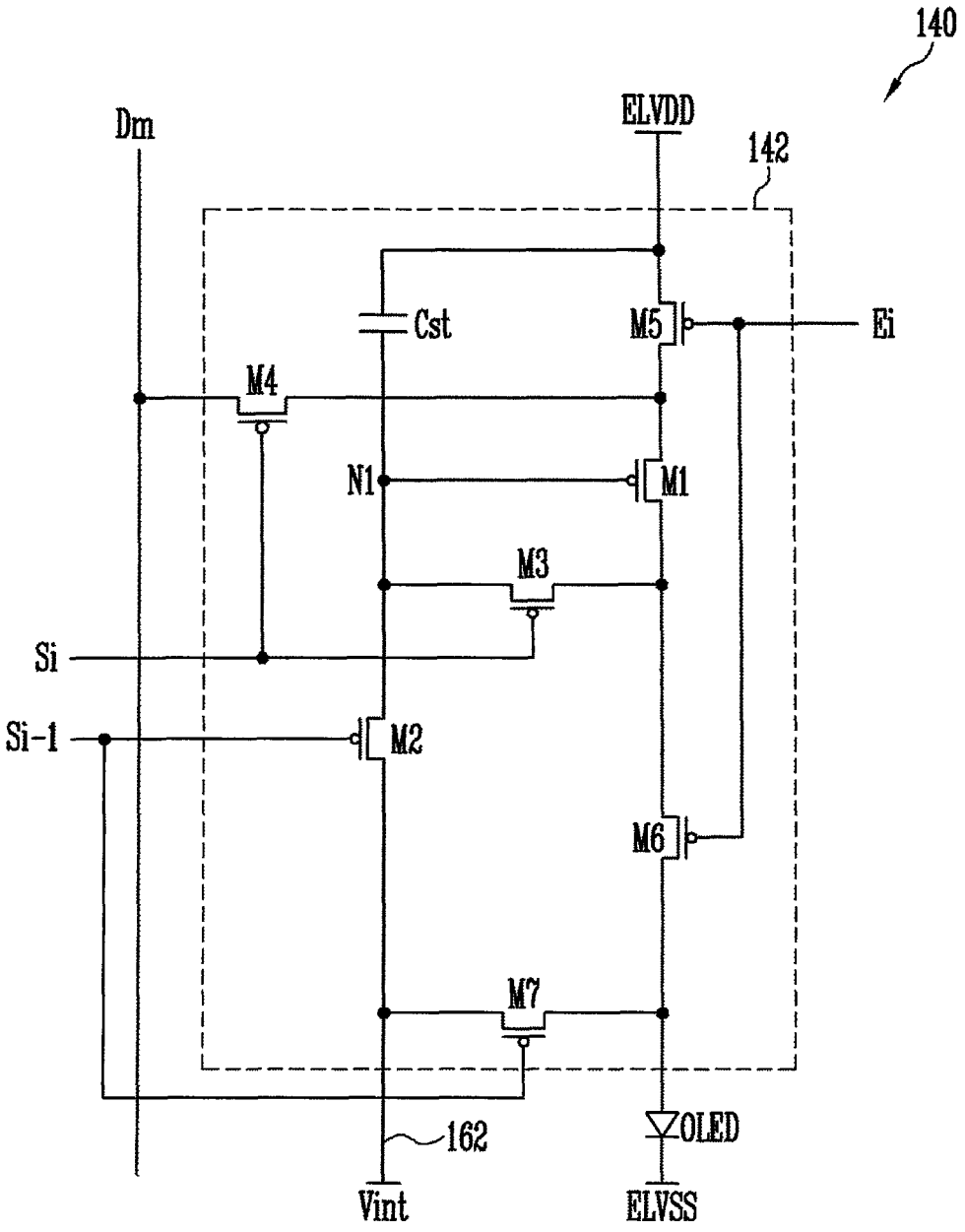
FIG. 2 is a circuit diagram illustrating an embodiment of the pixel of FIG. 1.

FIG. 2 is a circuit diagram illustrating an embodiment of the pixel of FIG. 1. In FIG. 2, for convenience sake, a pixel connected to the mth data line Dm and positioned in an ith horizontal line will be described.

Referring to FIG. 2, the pixel 140 according to the present embodiment includes a pixel circuit 142 connected to the organic light emitting diode OLED, to the data line Dm, to the scan lines Si-1 and Si, and to the emission control line Ei, the pixel circuit 142 being configured to control an amount of a current supplied to the organic light emitting diode OLED.

An anode electrode of the organic light emitting diode OLED is connected to the pixel circuit 142, and a cathode electrode of the organic light emitting diode OLED is connected to the second power source ELVSS. The organic light emitting diode OLED generates light with brightness corresponding to, and in response to, the amount of the current supplied from the pixel circuit 142. For this purpose, the first power source ELVDD has a higher voltage than the second power source ELVSS.

The pixel circuit 142 is configured to control the amount of the current that flows from the first power source ELVDD to the second power source ELVSS via the organic light emitting diode OLED in response to the data signal. For this purpose, the pixel circuit 142 includes first to seventh transistors M1 to M7 and a storage capacitor Cst.

A first electrode of the first transistor M1 (that is, a driving transistor) is connected to the first power source ELVDD via the fifth transistor M5, and a second electrode of the first transistor M1 is connected to the anode electrode of the organic light emitting diode OLED via the sixth transistor M6. The first transistor M1 controls the amount of the current that flows from the first power source ELVDD to the second power source ELVSS via the organic light emitting diode OLED in response to a voltage of a first node N1 to which a gate electrode of the first transistor M1 is connected.

The second transistor M2 is connected between the first node N1 and the initializing power source line 162 (that is, between the first node N1 and the initializing power source generator 160). A gate electrode of the second transistor M2 is connected to the (i−1)th scan line Si-1. The second transistor M2 is turned on when the scan signal is supplied to the (i−1)th scan line Si-1 to thereby supply the voltage of the initializing power source Vint to the first node N1.

The third transistor M3 is connected between the second electrode of the first transistor M1 and the first node N1. A gate electrode of the third transistor M3 is connected to the ith scan line Si. The third transistor M3 is turned on when the scan signal is supplied to the ith scan line Si to thereby electrically connect the second electrode of the first transistor M1 and the first node N1. Therefore, when the third transistor M3 is turned on, the first transistor M1 is diode-connected.

The fourth transistor M4 is connected between the data line Dm and the first electrode of the first transistor M1. A gate electrode of the fourth transistor M4 is connected to the ith scan line Si. The fourth transistor M4 is turned on when the scan signal is supplied to the ith scan line Si to thereby electrically connect the data line Dm and the first electrode of the first transistor M1.

The fifth transistor M5 is connected between the first power source ELVDD and the first electrode of the first transistor M1. A gate electrode of the fifth transistor M5 is connected to the ith emission control line Ei. The fifth transistor M5 is turned off when the emission control signal is supplied to the ith emission control line Ei, and is turned on otherwise.

The sixth transistor M6 is connected between the second electrode of the first transistor M1 and the anode electrode of the organic light emitting diode OLED. A gate electrode of the sixth transistor M6 is connected to the ith emission control line Ei. The sixth transistor M6 is turned off when the emission control signal is supplied to the ith emission control line Ei, and is turned on otherwise.

The seventh transistor M7 is connected between the initializing power source line 162 and the anode electrode of the organic light emitting diode OLED. A gate electrode of the seventh transistor M7 is connected to the (i−1)th scan line Si-1. The seventh transistor M7 is turned on when the scan signal is supplied to the (i−1)th scan line Si-1, and thereby supplies the voltage of the initializing power source Vint to the anode electrode of the organic light emitting diode OLED.

The seventh transistor M7 improves black display capability of the pixel 140. Specifically, when the seventh transistor M7 is turned on, a parasitic capacitance/capacitor of the organic light emitting diode OLED is discharged. Then, when black brightness is implemented, the organic light emitting diode OLED does not emit light by the leakage current from the first transistor M1 so that the black display capability may be improved.

In addition, in FIG. 2, the seventh transistor M7 is illustrated as being connected to the (i−1)th scan line Si-1. However, the present invention is not limited thereto. For example, the seventh transistor M7 may receive one of the scan signals that overlap the emission control signal supplied to the ith emission control line Ei.

The storage capacitor Cst is connected between the first power source ELVDD and the first node N1. The storage capacitor Cst is configured to store a voltage corresponding to the data signal.

On the other hand, according to the present invention, the structure of the pixel 140 is not limited to the structure of FIG. 2. For example, according to the present invention, the pixel 140 may be implemented in one of various forms including the first transistor M1 and the second transistor M2 for supplying the voltage of the initializing power source Vint to the first node N1.

Figure 3:
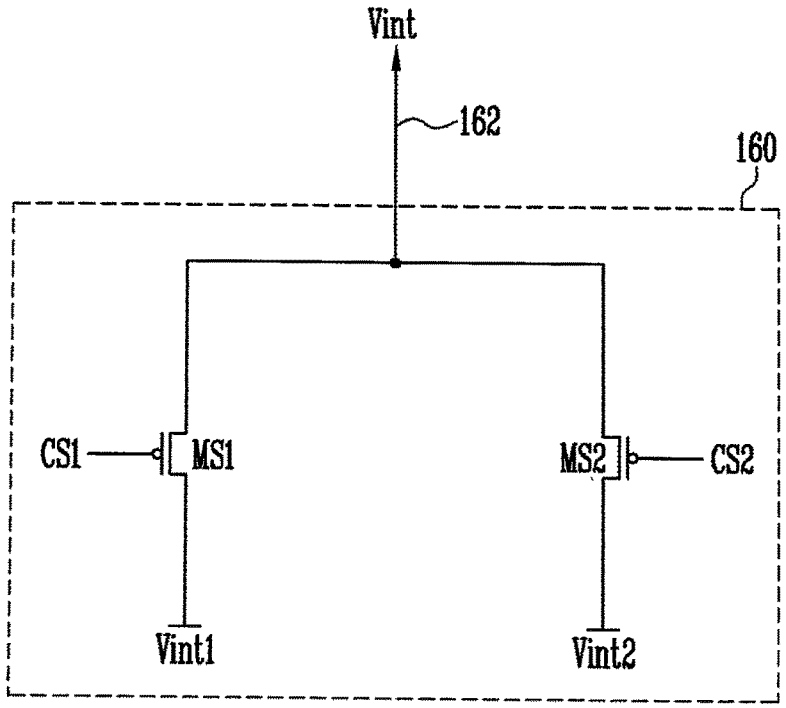
FIG. 3 is a view illustrating an embodiment of the initializing power source generator of FIG. 1.

FIG. 3 is a view illustrating an embodiment of the initializing power source generator of FIG. 1.

Referring to FIG. 3, the initializing power source generator 160 according to the present embodiment includes a first switching transistor MS1 and a second switching transistor MS2.

The first switching transistor MS1 is connected between the initializing power source line 162 and a first initializing power source Vint1. The first switching transistor MS1 is turned on when a first control signal CS1 is supplied to thereby supply the voltage of the first initializing power source Vint1 to the initializing power source line 162. Therefore, when the first switching transistor MS1 is turned on, the voltage of the first initializing power source Vint1 as the initializing power source Vint is supplied.

The first switching transistor MS1 is turned on in the first period in which the scan signals are supplied to the scan lines S1 to Sn during a normal frequency driving period and during the low frequency driving period. For this purpose, the first initializing power source Vint1 is set to have a lower voltage than the data signal.

The second switching transistor MS2 is connected between the initializing power source line 162 and a second initializing power source Vint2. The second switching transistor MS2 is turned on when a second control signal CS2 is supplied to thereby supply the voltage of the second initializing power source Vint2 to the initializing power source line 162. Therefore, when the second switching transistor MS2 is turned on, the voltage of the second initializing power source Vint2 as the initializing power source Vint is supplied.

The second switching transistor MS2 is turned on in the second period in which the scan signals are not supplied to the scan lines S1 to Sn during the low frequency driving period. The second initializing power source Vint2 is set to have a higher voltage than the first initializing power source Vint1.

Figure 4:
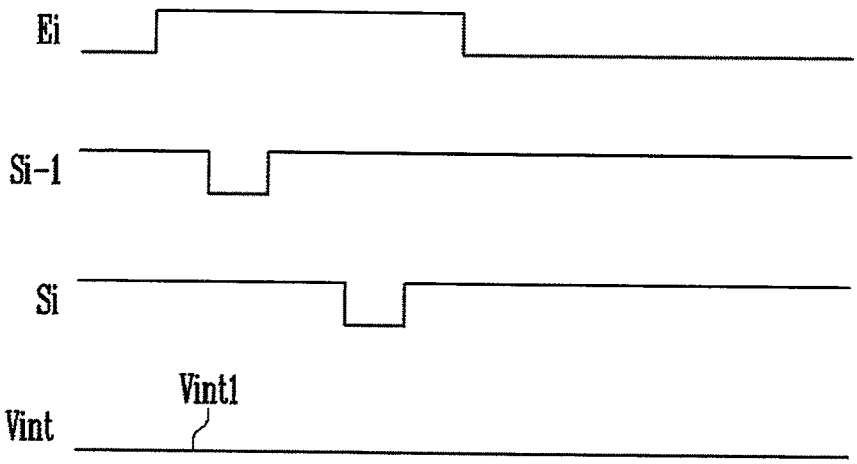
FIG. 4 is a waveform diagram illustrating an embodiment of operation processes of pixels in a normal frequency driving period and a first period of a low frequency driving period.

FIG. 4 is a waveform diagram illustrating an embodiment of operation processes of pixels during a normal frequency driving period and during a first period of a low frequency driving period. Here, the voltage of the first initializing power source Vint1 as the initializing power source Vint is supplied during the normal frequency driving period and during the first period of the low frequency driving period.

Referring to FIG. 4, first, the emission control signal is supplied to the ith emission control line Ei. When the emission control signal is supplied to the ith emission control line Ei, the fifth transistor M5 and the sixth transistor M6 are turned off. When the fifth transistor M5 is turned off, the first power source ELVDD and the first electrode of the first transistor M1 are electrically isolated from each other. When the sixth transistor M6 is turned off, the second electrode of the first transistor M1 and the anode electrode of the organic light emitting diode OLED are electrically isolated from each other. Therefore, in a period in which the emission control signal is supplied to the ith emission control line Ei, the pixel 140 is set to be in a non-emission state.

Then, the scan signal is supplied to the (i−1)th scan line Si-1. When the scan signal is supplied to the (i−1)th scan line Si-1, the second transistor M2 and the seventh transistor M7 are turned on. When the second transistor M2 is turned on, the voltage of the initializing power source Vint (that is, Vint1) is supplied to the first node N1. When the seventh transistor M7 is turned on, the voltage of the initializing power source Vint is supplied to the anode electrode of the organic light emitting diode OLED so that the parasitic capacitor of the organic light emitting diode OLED is discharged.

After the scan signal is supplied to the (i−1)th scan line Si-1, the scan signal is supplied to the ith scan line Si. When the scan signal is supplied to the ith scan line Si, the third transistor M3 and the fourth transistor M4 are turned on.

When the third transistor M3 is turned on, the first node N1 and the second electrode of the first transistor M1 are electrically connected. That is, when the third transistor M3 is turned on, the first transistor M1 is diode-connected.

When the fourth transistor M4 is turned on, the data signal is supplied from the data line Dm to the first electrode of the first transistor M1. At this time, because the first node N1 is initialized to the voltage of the initializing power source Vint, the first transistor M1 is turned on. When the first transistor M1 is turned on, a voltage obtained by subtracting an absolute value of a threshold voltage of the first transistor M1 from the voltage of the data signal is supplied to the first node N1. At this time, the storage capacitor Cst stores the voltage of the data signal and the threshold voltage of the first transistor M1.

After the voltage of the data signal and the threshold voltage of the first transistor M1 are stored in the storage capacitor Cst, supply of the emission control signal to the ith emission control line Ei is stopped. When the supply of the emission control signal to the ith emission control line Ei is stopped, the fifth transistor M5 and the sixth transistor M6 are turned on. When the fifth transistor M5 is turned on, the first power source ELVDD and the first electrode of the first transistor M1 are electrically connected. When the sixth transistor M6 is turned on, the second electrode of the first transistor M1 and the anode electrode of the organic light emitting diode OLED are electrically connected.

At this time, the first transistor M1 controls an amount of the current that flows from the first power source ELVDD to the second power source ELVSS via the organic light emitting diode OLED in response to the voltage of the first node N1. Then, the organic light emitting diode OLED generates light in response to, and with a brightness corresponding to, the amount of the current supplied from the first transistor M1.

During the normal frequency driving period and during the first period of the low frequency driving period, the pixels 140 generate the light components with the brightness components corresponding to the data signals by the above-described processes.

Figure 5:
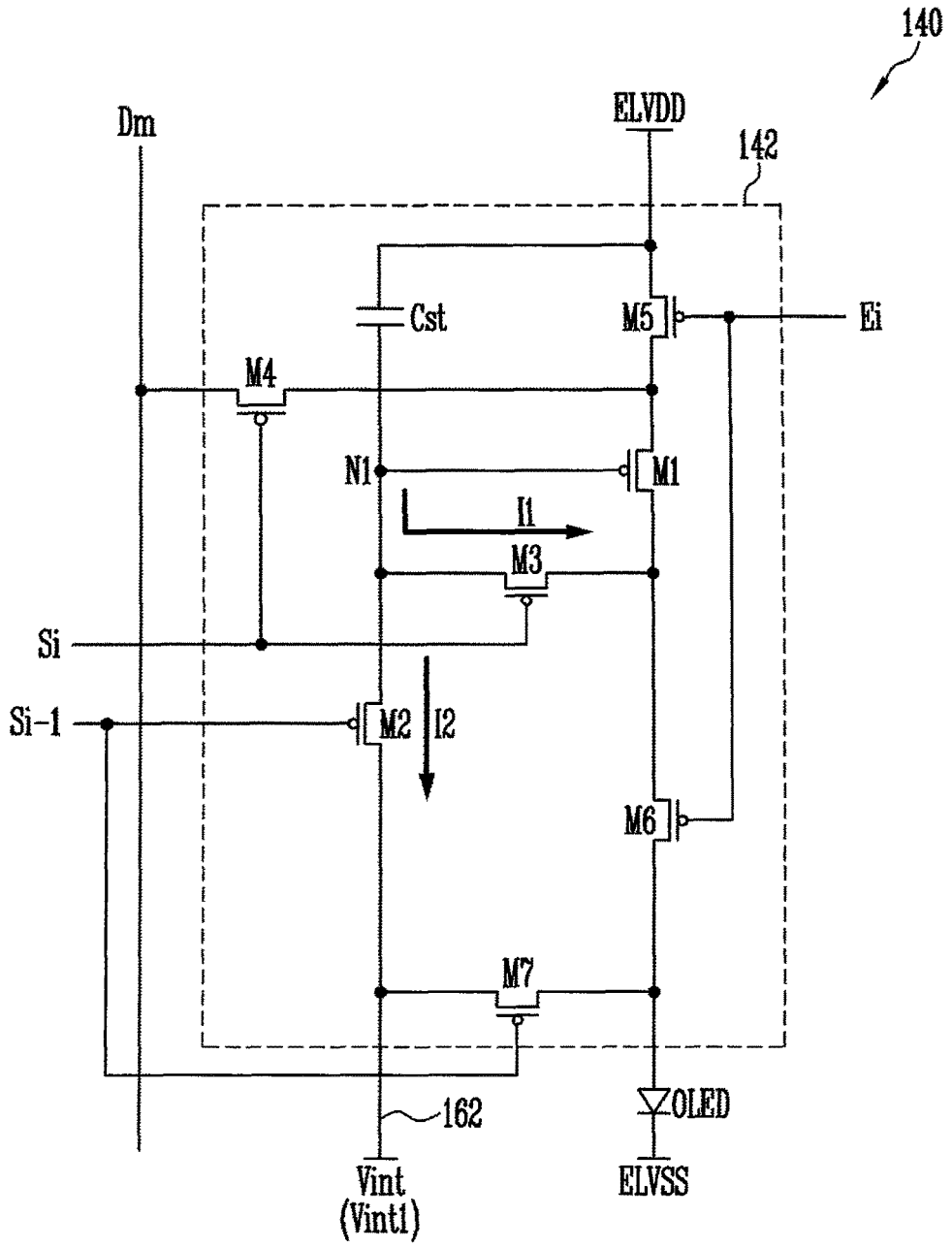
FIG. 5 is a view illustrating a leakage current of pixels driven by the driving method of FIG. 4.

FIG. 5 is a view illustrating a leakage current of pixels driven by the driving method of FIG. 4.

Referring to FIG. 5, in a period in which the pixels 140 emit light components, the first node N1 is set to have a higher voltage than the initializing power source Vint (that is, Vint1). Therefore, the voltage of the first node N1 of each of the pixels 140 is changed by a first leakage current I1 that flows from the first node N1 to the organic light emitting diode OLED, and is changed by a second leakage current I2 that flows from the first node N1 to the initializing power source Vint.

The leakage currents I1 and I2 do not significantly matter during the normal frequency driving period. However, when the pixels 140 are driven by the low frequency driving method, flicker may be generated due to the leakage currents I1 and I2. Therefore, according to embodiments of the present invention, the second initializing power source Vint2 as the initializing power source Vint is supplied during the second period of the low frequency driving period so that it is possible to reduce or minimize the leakage current and to improve display quality.

Figure 6:
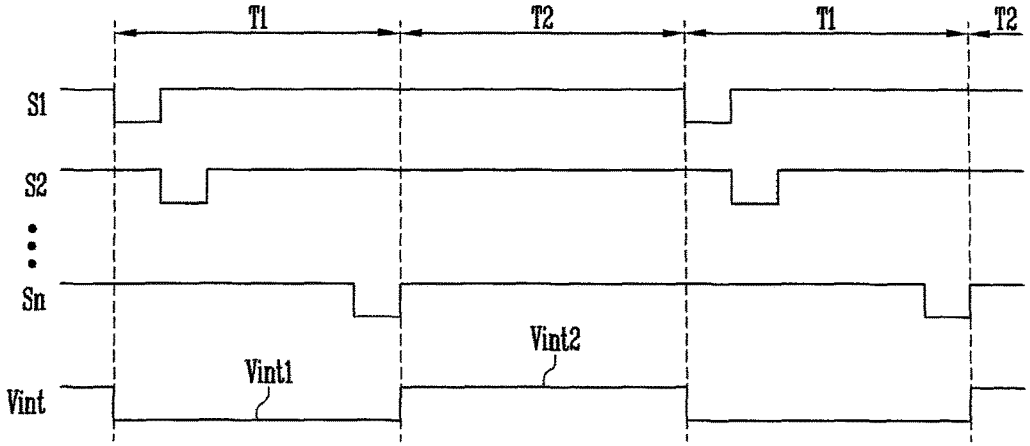
FIG. 6 is a view illustrating an embodiment of driving waveforms supplied in a low frequency driving period.

FIG. 6 is a view illustrating an embodiment of driving waveforms supplied during a low frequency driving period.

Referring to FIG. 6, during the first period T1 of the low frequency driving period, the initializing power source generator 160 supplies the first initializing power source Vint1 as the initializing power source Vint. In the second period T2 of the low frequency driving period, the initializing power source generator 160 supplies the second initializing power source Vint2 as the initializing power source Vint.

That is, according to the present invention, during the second period T2 in which the pixels 140 emit light components in response to the data signals supplied during the first period T1, the second initializing power source Vint2 is supplied so that it is possible to reduce or minimize the leakage current. For example, the second initializing power source Vint2 may be set to have a voltage that is higher than that of the first node N1 included in each of the pixels 140.

Figure 7:
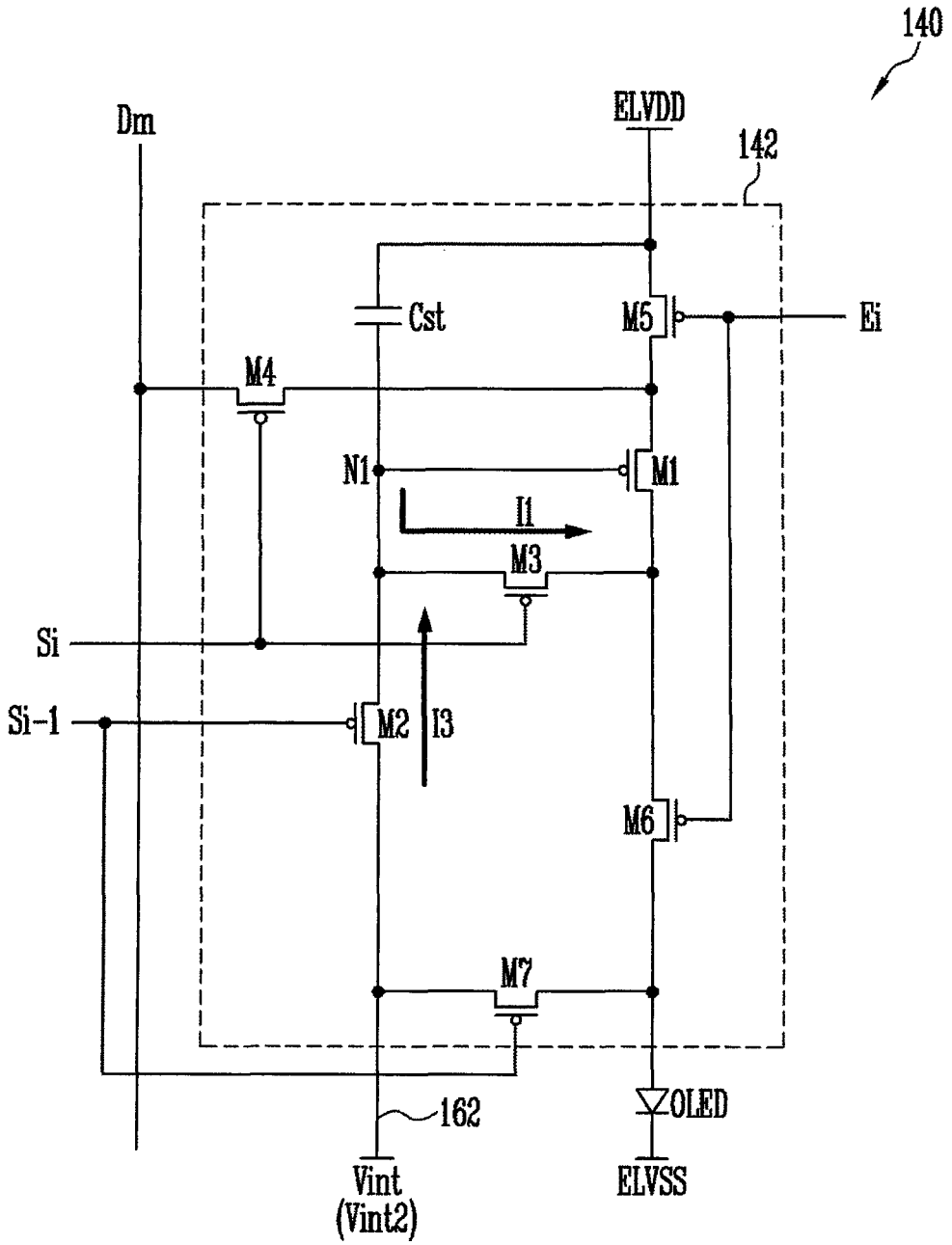
FIG. 7 is a view illustrating a current flow in the second period of FIG. 6.

Then, as illustrated in FIG. 7, during the second period T2, a third current I3 is supplied from the second initializing power source Vint2 to the first node N1. In this case, loss of the voltage of the first node N1 that is caused by the first leakage current I1 may be compensated for by using the third current I3, thereby improving display quality. On the other hand, according to embodiments of the present invention, the voltage of the second initializing power source Vint2 may be experimentally determined so that the first node N1 of each of the pixels 140 may maintain a stable voltage during the second period T2.

Figure 8:
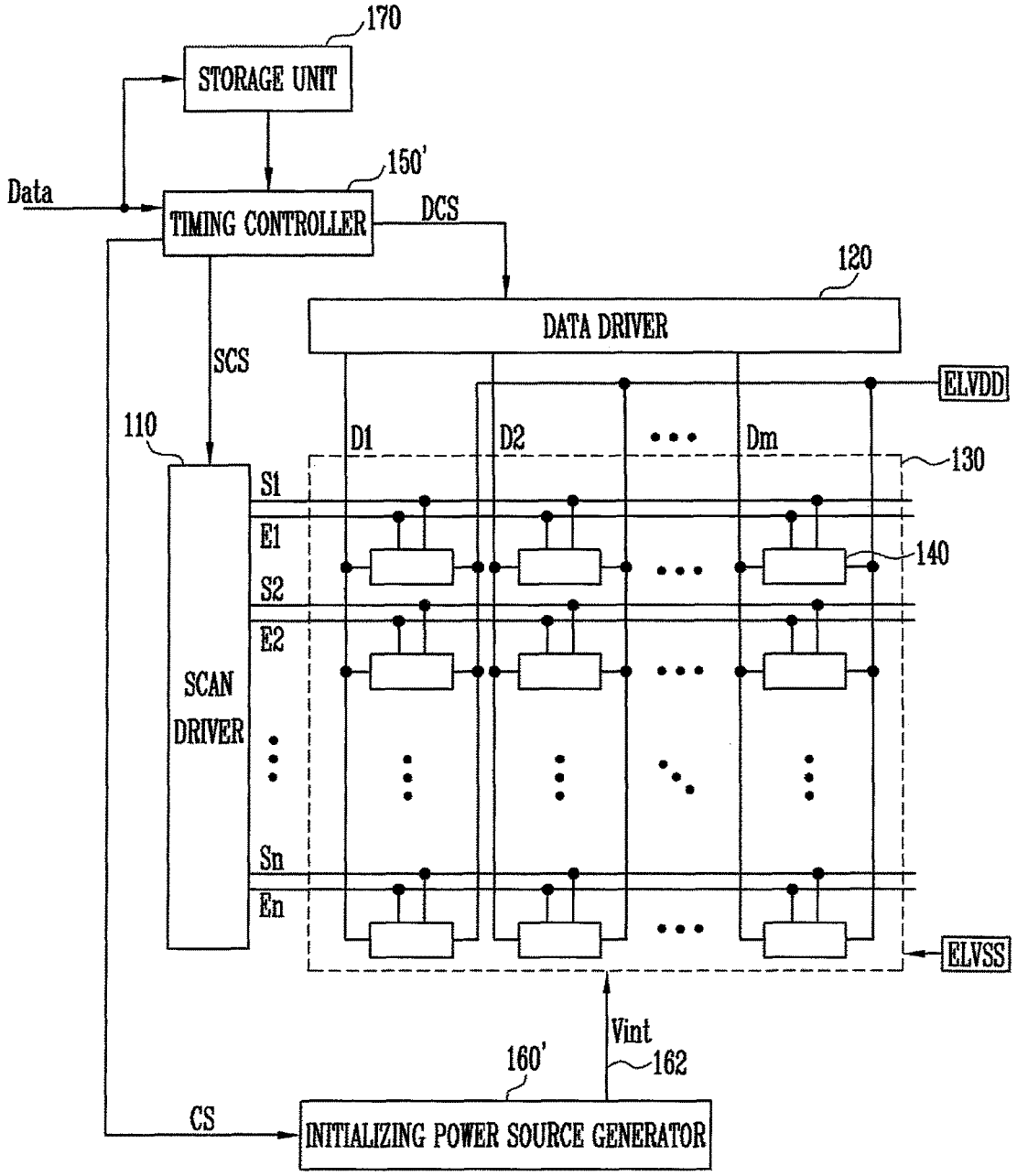
FIG. 8 is a view illustrating an organic light emitting display device according to another embodiment of the present invention.

FIG. 8 is a view illustrating an organic light emitting display device according to another embodiment of the present invention. In FIG. 8, the same elements as those of FIG. 1 are denoted by the same reference numerals, and repeated detailed description thereof will not be given.

Referring to FIG. 8, the organic light emitting display device according to another embodiment of the present invention includes a storage unit 170.

The storage unit 170 stores data items (e.g., information) to be supplied during the first period T1 of the low frequency driving period.

A timing controller 150' supplies one of CS2 to CSj (j is a natural number larger than 2) among the plurality of control signals CS during the second period T2 of the low frequency driving period in response to the data items stored in the storage unit 170.

An initializing power source generator 160' supplies one of a second initializing power source Vint2 to a jth initializing power source Vintj in response to the corresponding control signal (one of CS2 to CSj) that is received from the timing controller 150' during the second period T2 of the low frequency driving period. Here, the second initializing power source Vint2 to the jth initializing power source Vintj are set to have higher voltages than the first initializing power source Vint1 supplied in the first period T1.

The above-described organic light emitting display device controls the voltage of the initializing power source Vint supplied to the pixels 140 in response to the data items stored in the storage unit 170 during the second period T2. In this case, a value of the voltage of the initializing power source Vint supplied in the second period T2 may be set so that the voltage of the first node N1 included in each of the pixels 140 may be stably maintained. Therefore, it is possible to further improve the display quality.

Figure 9:
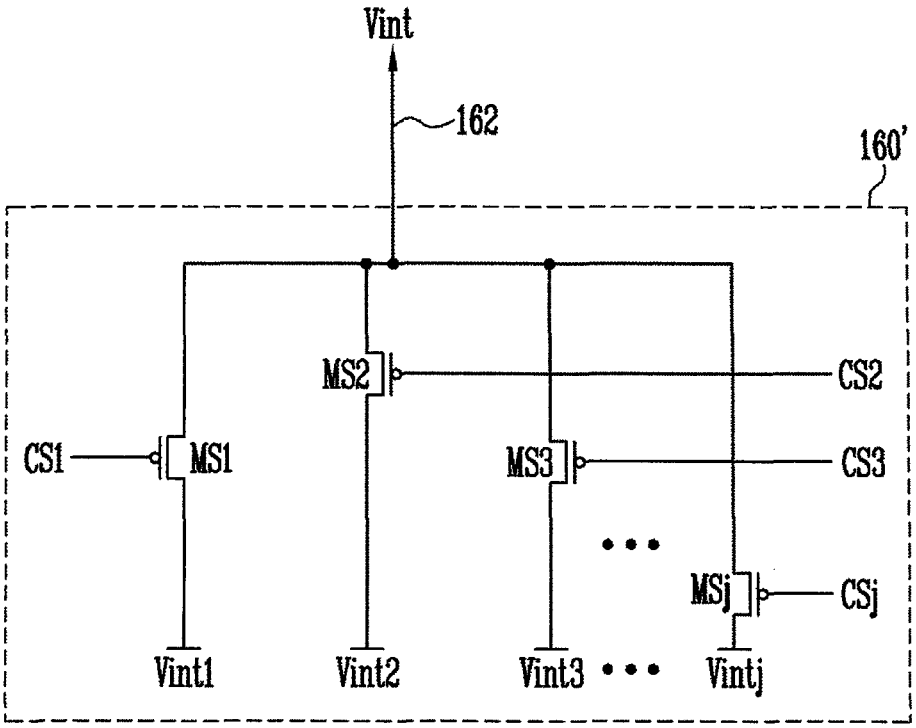
FIG. 9 is a view illustrating an embodiment of the initializing power source generator of FIG. 8.

FIG. 9 is a view illustrating an embodiment of the initializing power source generator of FIG. 8.

Referring to FIG. 9, the initializing power source generator 160' according to the present embodiment includes a first switching transistor MS1 to a jth switching transistor MSj.

The first switching transistor MS1 is connected between the initializing power source line 162 and the first initializing power source Vint1. The first switching transistor MS1 is turned on when the first control signal CS1 is supplied to thereby the voltage of the first initializing power source Vint1 to the initializing power source line 162. Therefore, when the first switching transistor MS1 is turned on, the voltage of the first initializing power source Vint1 as the initializing power source Vint is supplied.

The first switching transistor MS1 is turned on during the normal frequency driving period and during the first period T1 of the low frequency driving period. For this purpose, the first initializing power source Vint1 is set to have a lower voltage than the data signal.

The second switching transistor MS2 is connected to the second initializing power source Vint2, the third switching transistor MS3 is connected to the third initializing power source Vint3, etc., and the jth switching transistor MSj is connected the jth initializing power source Vintj. One of the second switching transistor MS2 to the jth switching transistor MSj may be turned on during the second period T2 of the low frequency driving period to thereby supply the initializing power source (e.g., a corresponding one of Vint2 to Vintj) connected thereto to the initializing power source line 162. For this purpose, the timing controller 150' supplies one control signal CS of the second control signal CS2 to the jth control signal CSj during the second period T2 of the low frequency driving period.

In addition, the timing controller 150' is configured to determine a control signal (one of CS2 to CSj) to be supplied during the second period T2 in response to the data items stored in the storage unit 170. That is, the timing controller 150' supplies the control signal (one of CS2 to CSj) in response to the data items stored in the storage unit 170 so that the voltage of the first node N1 included in each of the pixels 140 is stably maintained. For this purpose, the second initializing power source Vint2 to the jth initializing power source Vintj may be set to have different voltage values.

In addition, the second initializing power source Vint2 to the jth initializing power source Vintj are each set to have a higher voltage than that of the first initializing power source Vint1. For example, the second initializing power source Vint2 to the jth initializing power source Vintj may be experimentally determined in response to the data items supplied in the first period T1 so that the voltage of the first node N1 included in each of the pixels 140 may be stably maintained.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display device comprising:

a scan driver configured to supply scan signals to scan lines, and configured to supply emission control signals to emission control lines;

a data driver configured to supply data signals to data lines during a first period;

pixels respectively positioned at regions defined by the scan lines and the data lines, and respectively comprising driving transistors configured to be initialized by a voltage of an initializing power source;

an initializing power source generator configured to supply the voltage of the initializing power source to an initializing power source line commonly connected to the pixels; and a timing controller configured to control the scan driver, the data driver, and the initializing power source generator, wherein the scan driver is configured to supply the scan signals to the scan lines during the first period, and configured not to supply the scan signals to the scan lines during a second period, wherein the first period and the second period are not overlapped, wherein the initializing power source generator is configured to supply the initializing power source having different voltages during the first period and the second period, wherein the initializing power source generator is configured to supply a voltage of a first initializing power source in the first period, and is configured to supply a voltage of a second initializing power source in the second period, wherein the second initializing power source has a higher voltage than the first initializing power source, and wherein the scan driver is configured to supply all of the scan signals to the scan lines during the first period, and configured to supply none of the scan signals to the scan lines during the second period.

2. The organic light emitting display device of claim 1, wherein the first initializing power source has a lower voltage than the data signals.

3. The organic light emitting display device of claim 1, wherein the initializing power source generator comprises:

a first switching transistor connected between the first initializing power source and the initializing power source line, and configured to be turned on during the first period; and a second switching transistor connected between the second initializing power source and the initializing power source line, and configured to be turned on in the second period.

4. The organic light emitting display device of claim 1, further comprising a storage unit configured to store data items to be supplied during the first period.

5. The organic light emitting display device of claim 4, wherein the initializing power source generator is configured to supply a voltage of a first initializing power source in the first period, and is configured to supply a voltage of one of a second initializing power source to a jth initializing power source in the second period, j being a natural number larger than 2.

6. The organic light emitting display device of claim 5, wherein the initializing power source generator is configured to supply the voltage of one of the second initializing power source to the jth initializing power source in response to the data items stored in the storage unit.

7. The organic light emitting display device of claim 5, wherein the first initializing power source has a lower voltage than the data signals.

8. The organic light emitting display device of claim 5, wherein the second initializing power source to the jth initializing power source each have a higher voltage than the first initializing power source.

9. The organic light emitting display device of claim 5, wherein the initializing power source generator comprises:

a first switching transistor connected between the first initializing power source and the initializing power source line, and configured to be turned on in the first period; and second to jth switching transistors connected between the initializing power source line and a respective one of the second initializing power source to the jth initializing power source.

10. The organic light emitting display device of claim 9, wherein the timing controller is configured to turn on the first switching transistor during the first period, and is configured to turn on one of the second switching transistor to the jth switching transistor in response to the data items stored in the storage unit during the second period.

11. The organic light emitting display device of claim 1, wherein at least one of the pixels comprises:

an organic light emitting diode (OLED);

a corresponding one of the driving transistors as a first transistor that is configured to control an amount of a current supplied from a first power source, which is connected to a first electrode of the first transistor, to the OLED, which is connected to a second electrode of the first transistor, in response to a voltage of a first node; and a second transistor connected between the initializing power source line and the first node, and configured to be turned on when a scan signal of the scan signals is supplied to a previous scan line of the scan lines.

12. The organic light emitting display device of claim 11, wherein the at least one of the pixels further comprises:

a third transistor connected between the second electrode of the first transistor and the first node, and configured to be turned on when a scan signal of the scan signals is supplied to a present scan line of the scan lines;

a fourth transistor connected between a data line and the first electrode of the first transistor, and configured to be turned on when the scan signal is supplied to the present scan line;

a fifth transistor connected between the first power source and the first electrode of the first transistor, and configured to be turned off when an emission control signal of the emission control signals is supplied to a present emission control line of the emission control lines;

a sixth transistor connected between the second electrode of the first transistor and an anode electrode of the OLED, and configured to be turned off when the emission control signal is supplied to the present emission control line; and a storage capacitor connected between the first power source and the first node.

13. The organic light emitting display device of claim 12, wherein the at least one of the pixels further comprises a seventh transistor connected between the initializing power source line and the anode electrode of the OLED, and configured to be turned on in at least a partial period of a period during which the emission control signal is supplied to the present emission control line.

* * * * *